US005727712A

United States Patent [19]

Costello

[11] Patent Number: 5,727,712

[45] Date of Patent: Mar. 17, 1998

[54] ICE RETAINER

[76] Inventor: James Joseph John Costello, 9820 Memorial Dr., Apt. 79, Houston, Tex. 77024

[21] Appl. No.: 754,241

[22] Filed: Nov. 20, 1996

[51] Int. Cl.[6] ..... B65D 23/00

[52] U.S. Cl. ..... 220/703; 220/719

[58] Field of Search ..... 220/703, 719

[56] References Cited

U.S. PATENT DOCUMENTS

| | | | |
|---|---|---|---|
| 2,357,063 | 8/1944 | Swing | 220/703 X |
| 2,744,631 | 5/1956 | Toombs | 220/703 X |
| 2,753,049 | 7/1956 | Gaines et al. | 220/703 X |
| 2,753,050 | 7/1956 | Langston | 220/703 X |
| 3,917,533 | 11/1975 | Macaluso, Jr. . | |
| 3,940,012 | 2/1976 | Addington | 220/719 |
| 4,020,532 | 5/1977 | Lichter | 220/703 X |
| 4,134,494 | 1/1979 | Wong . | |
| 4,938,375 | 7/1990 | Fantacone | 220/719 X |
| 4,948,009 | 8/1990 | Sawatani . | |
| 5,065,881 | 11/1991 | Tarng . | |

FOREIGN PATENT DOCUMENTS

| | | | |
|---|---|---|---|
| 2254540 | 10/1992 | United Kingdom | 220/703 |

*Primary Examiner*—Steven M. Pollard
*Attorney, Agent, or Firm*—Browning Bushman

[57] ABSTRACT

The present invention is directed to a device for retaining ice in a drinking glass while permitting the beverage therein to be enjoyed. The device comprises a shield shaped to conform generally to at least a portion of an interior cross-section of the glass at a chosen distance below the lip thereof. The device further includes a stem attached at one end to the shield and at the other end to a clip. The stem is of a length so that the shield will be positioned at the chosen distance below the lip of the glass when the clip is engaged on the lip thereof. In the preferred embodiments, the shield is substantially the same size as the interior cross-section of the glass at the chosen distance and includes a plurality of holes sized to retain the ice in the glass while permitting the beverage to flow freely therethrough. In the most preferred embodiments, the clip is pivotally attached to the opposite end of the stem and spring biassed to firmly engage the lip of the drinking glass. Finally, the present invention includes the combination of an ice retainer together with a drinking glass or other beverage container especially designed so that the ice retainer is completely disposed below the lip of the cooperating glass or container.

17 Claims, 4 Drawing Sheets

ICE RETAINER

BACKGROUND OF THE INVENTION

1. Field of the Invention

The present invention generally relates to a device for retaining solids within a vessel while permitting liquids to be poured or imbibed therefrom. More specifically, the present invention is directed to a device for retaining ice within a drinking glass or pitcher while permitting the drinking or pouting of a beverage therein.

2. Description of the Background

Everyone has experienced the embarrassment caused by the surging and spilling of a beverage as a result of the dislodgement and sudden movement of a mass of ice cubes in his drinking glass. Various approaches have been taken to solve this problem.

One early approach to solving this problem was the use of a cover or lid to seal the top of the drinking glass. Safe drinking could be accomplished by placing a straw in a small hole in the lid. An example of one conventional device is the straw insertable lid for use with paper cups disclosed in U.S. Pat. No. 4,948,009. This lid is exemplary of plastic lids fitted for engagement with the top of a paper cup and slotted for receiving a straw to permit drinking of the beverage therein. Another example of an approach to solve this problem is disclosed in U.S. Pat. No. 5,065,881. One embodiment of the device disclosed in the '881 patent comprises a cap for engagement with the top of a glass, beverage can or other container and including a straw or spout through which the beverage may be sipped.

Because the lids or caps disclosed in the foregoing patents must firmly engage the top of the drinking glasses with which they are used, they may only be used with a glass of a particular size. Accordingly, the foregoing devices could not serve as universal ice retainers with glasses or cups in a variety of sizes and shapes.

In an effort to overcome the deficiencies of devices similar to those disclosed in the foregoing patents, a universal ice guard was disclosed in U.S. Pat. No. 3,917,533. The ice guard disclosed in the '533 patent merely comprised a flexible shield to be clipped across a portion of the top of a drinking glass. The flexibility of the shield aided both in holding it in place across the drinking vessel and in returning it to a flat configuration for storage.

A completely different approach was taken by the inventor of the device described in U.S. Pat. No. 4,134,494. The combination straw and self-contained ice cooler described in the '494 patent solved the problem by removing free-floating ice from the drink. By filling the enlarged, spherical portion of this combination straw/cooler with water, followed by plugging and freezing of the filled device, no free-floating ice would be required in the beverage container. Thus, the problem was solved by removing ice from the container while cooling was provided through the ice restrained within the enlarged, spherical portion of the combined straw/cooler.

While the foregoing patents offered various approaches to solving the problem of dislodging ice and surging beverages, none of those solutions appear to have been commercially successful. The consuming public still faces the embarrassment of spilled beverages upon unexpected movement of the ice therein. Accordingly, there has been a long felt but unfulfilled need by the consuming public for an inexpensive, attractive and universal ice guard. The present invention solves that need.

SUMMARY OF THE INVENTION

In one aspect, the present invention is directed to a universal device for retaining solids within a vessel containing both a liquid and solids. While the device could be used for many purposes, e.g., it could be used to strain liquids from cans of vegetables, it is intended primarily for use as a retainer for ice in glasses or pitchers of chilled beverages.

In its broadest aspects, the device comprises a shield for holding the solids in a vessel wherein the shield is shaped to conform generally to at least a portion of an interior cross-section of the vessel at a chosen distance below a lip of the vessel. The device further includes a clip for engaging the device to the lip of the vessel. The device further includes a stem affixed at a first end to the shield and engaged at a second end to the clip.

In the preferred embodiments, the shield further comprises at least one, and preferrably a plurality, of openings sized to retain substantially all of the solids in the vessel while permitting any liquid to pass therethrough. In the preferred embodiments, the stem terminates at the second end in a yoke so that the stem is pivotally engaged with the clip so that the position of the shield within the vessel may be adjusted if required by the contour of the vessel wall. In the preferred embodiments, the clip is biassed, most preferably with a spring, for engagement with the lip of the vessel. Alternatively, the clip may simply be sized to frictionally engage the lip of the vessel.

In the most preferred embodiments, the shield is circular in shape and substantially the same size as an interior cross-section of the vessel. In these most preferred embodiments, the shield further includes a plurality of slots or holes comprising the openings through which the liquid may pass.

Another preferred embodiment of the present invention comprises in combination a beverage container and ice retainer in accord with the device described above. In this preferred embodiment, the shield of the ice retainer is circular in shape and substantially the same size as an interior cross-section of the vessel at a selected distance below a lip of the vessel. In this embodiment, the stem is of a length to position the shield at a selected distance below the lip of the vessel when the clip is engaged with the lip. In these embodiments, the vessel preferably includes a recess, groove, notch or the like for receiving therein the clip of the ice retainer. In the most preferred embodiments of this combination, the ice retainer is disposed below the lip of the vessel when in use.

An ice retainer in accord with the present invention provides an attractive and inexpensive means for solving the age old problem of dislodging ice and surging beverages and the embarrassment caused by those beverages cascading over the drinker. Thus, the long felt but unfulfilled need for an effective and attractive ice retainer has been met. These and other meritorious features and advantages of the present invention will be more fully appreciated from the following detailed description and claims.

BRIEF DESCRIPTION OF THE DRAWINGS

Other features and intended advantages of the present invention will be more readily apparent by the references to the following detailed description in connection with the accompanying drawings, wherein.

While the invention will be described in connection with the presently preferred embodiments, it will be understood that it is not intended to limit the invention to those embodiments. On the contrary, it is intended to cover all alternatives, modifications and equivalents as may be included in the spirit of the invention as defined in the appended claims.

DETAILED DESCRIPTION OF THE PREFERRED EMBODIMENTS

The present invention provides an improved retainer for restraining solids within a container while permitting liquids to be poured or imbibed therefrom. The present invention is particularly useful as an ice retainer for holding ice within a drinking glass or pitcher while permitting a chilled beverage to be poured or imbibed therefrom.

One embodiment of the present invention includes a shield, stem and spring biassed clip serves readily as a universal ice or solids retainer. This embodiment is adapted for use with a variety of glasses, cups, pitchers or other drinking vessels. In fact, this embodiment may even be used with cans or jars containing a variety of food items, e.g., vegetables and fruits, to separate the liquids therefrom.

In other embodiments, the present invention comprises in combination an ice retainer and drinking glass specifically designed for use therewith. These embodiments provide attractive combinations which may be inexpensively manufactured and sold as sets for use in a variety of casual settings.

Figure 2:
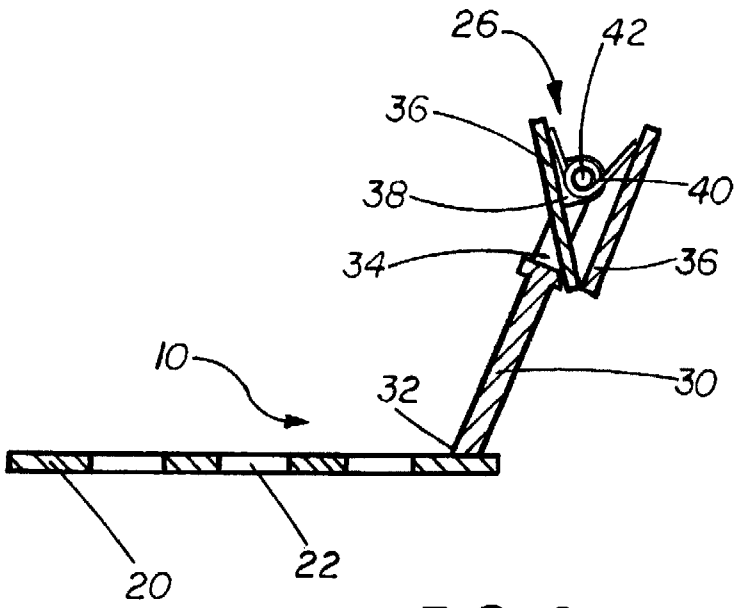
FIG. 2 is a cross-sectional illustration through line 2—2 of FIG. 1 of a universal ice retainer in accord with the present invention.
Figure 1:
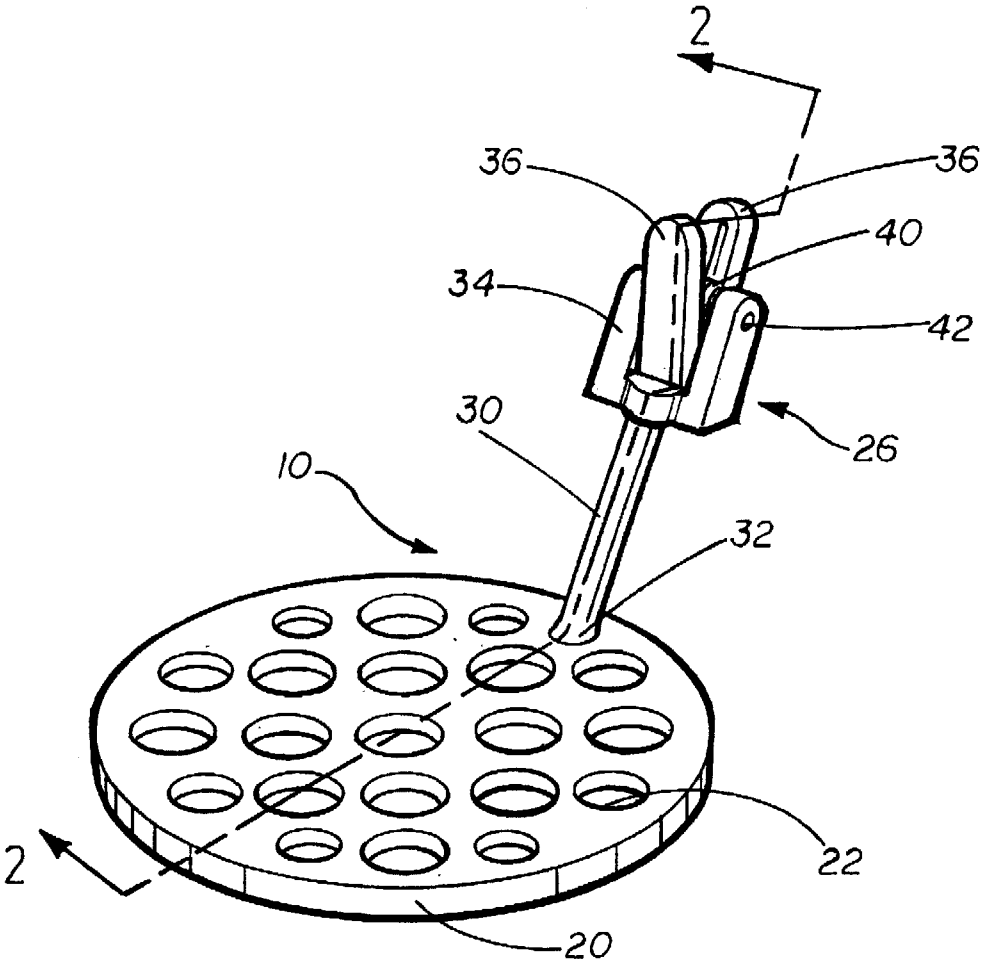
FIG. 1 is a perspective illustration of a universal ice retainer in accord with the present invention.
Figure 3:
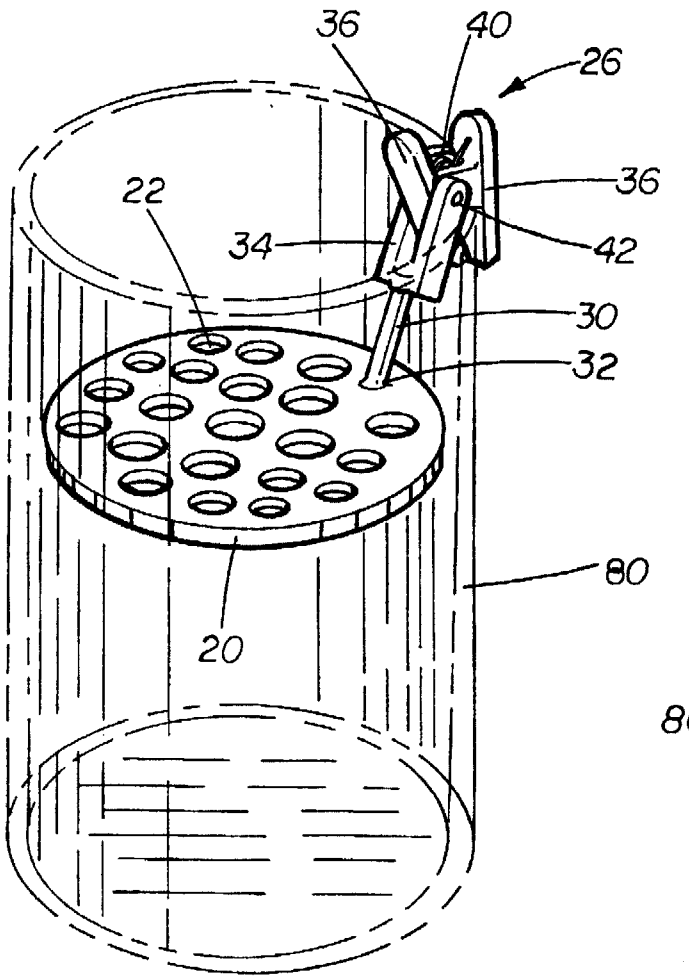
FIG. 3 is a perspective illustration of the ice retainer of FIG. 1 disposed in a ghosted drinking vessel.

FIGS. 1–3 illustrate a presently preferred universal ice retainer 10 in accord with the present invention. Ice retainer 10 comprises shield 20 having a circular configuration in this preferred embodiment. In other embodiments shield 20 could take other shapes to conform to all or a portion of the interior surface of the vessel with which ice retainer 10 would be used. In the preferred embodiment illustrated, shield 20 includes a plurality of holes 22 sized to retain ice cubes or crushed ice while permitting passage therethrough of a chilled beverage or other liquid.

While circular holes 22 are illustrated in shield 20, those skilled in the art will be aware that any appropriate configuration may be used. For example, one or more slots may serve the same purpose. In an alternative embodiment, particularly useful on cans or jars for straining liquids from vegetables and fruits, shield 20 may even take the form of a screen spanning a solid, circular periphery to which stem 30 is attached.

Shield 20 is disposed at one end 32 of stem 30. While it is preferred that stem 30 be fixedly attached to shield 20, in alternative embodiments these parts could be hinged together or could be detachable for easy cleaning and storage. While stem 30 may be of any length, it is designed to position shield 20 at a depth below the lip of drinking glass 80 or other vessel with which it is used. See FIG. 3 wherein ice retainer 10 is illustrated disposed within glass 80.

At the opposite end of stem 30 is clip 26 designed to firmly engage ice retainer 10 with the lip of glass 80. In the preferred embodiment illustrated in FIGS. 1–3, clip 26 comprises a pair of opposed arms 36 affixed through tabs 38 for rotation about pin 42 disposed across the opening of yoke 34 on the end of stem 30. Opposed arms 36 are biassed to the dosed position by spring 40 carried about pin 42 and having ends pressing against the interior, top surfaces of arms 36. By compressing biassing spring 40, clamp 26 may be placed over the lip of glass 80 as illustrated in FIG. 3. When so positioned, ice or other solids below shield 20 and larger than holes 22 will be retained within glass 80 while liquids therein may be easily poured or consumed.

An ice retainer in accord with the present invention may be constructed with any appropriate, water resistant material. While metal or wood may be employed, plastic is preferred. Particularly preferred are plastics which may be injection molded, e.g., polypropylene, high density polyethylene, polycarbonate and polystyrene. These injection moldable plastics produce inexpensive yet attractive products.

Figure 4:
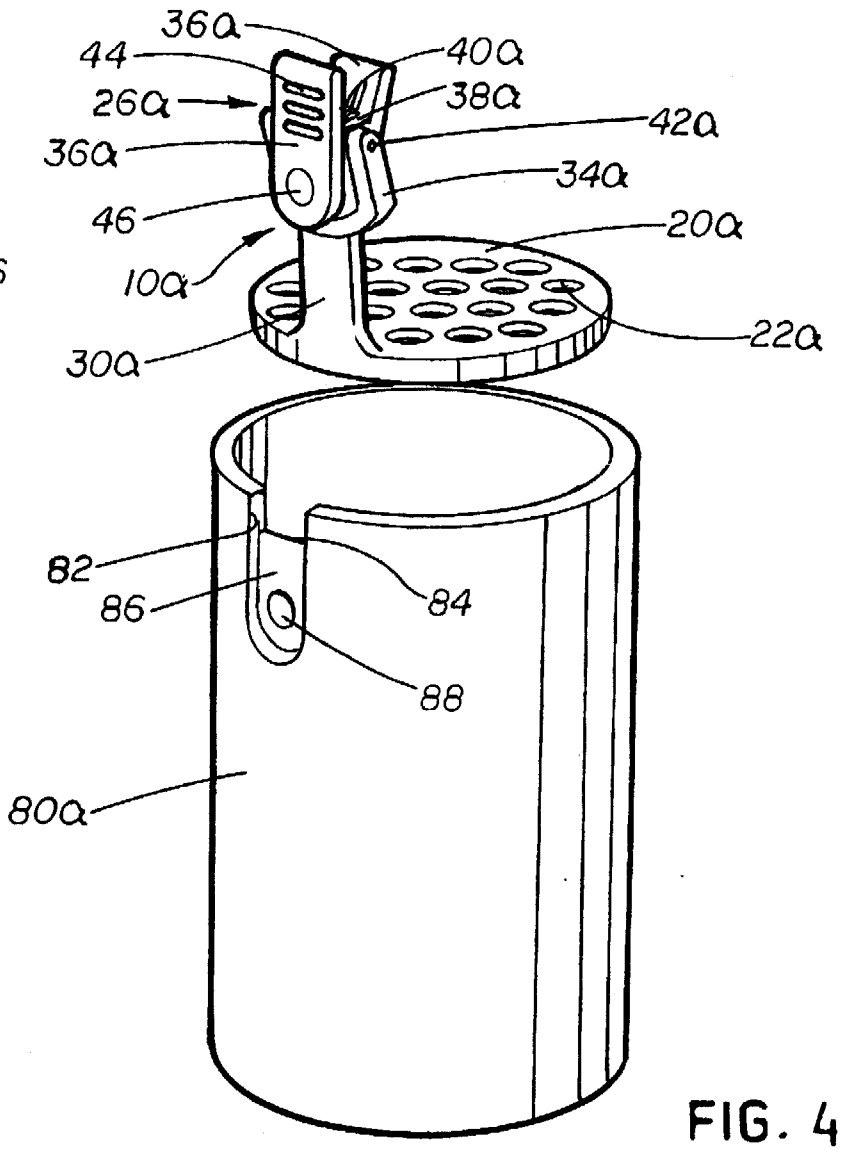
FIG. 4 is a perspective illustration of an alternative ice retainer in accord with the present invention in combination with a cooperating drinking vessel having a recess therein so that the ice retainer is disposed below the surface of the drinking vessel.

Another embodiment of the present invention comprising an alternative ice retainer **10*a* for use with a specifically designed and cooperating glass 80*a* is illustrated in FIG. 4. In this embodiment, ice retainer 10*a* comprises circular shield 20*a* configured to closely conform to the interior cross-section of glass 80*a*. Shield 20*a* has therein a plurality of holes 22*a* to permit drinking of the beverage placed in glass 80*a* while retaining ice therein. Shield 20*a* is connected with clip 26*a* through stem 30*a*. Clip 26*a* is similar to clip 26 with a pair of opposed arms 36*a* carried by securing tabs 38*a* on pin 42*a* disposed across the gap of yoke 34*a* on the end of stem 30*a*. Arms 36*a* are biassed to the closed position with spring 40*a* carried about pin 42*a*. In this alternative embodiment, opposed arms 36*a* include on the surface thereof ridges 44** to provide a decorative appearance and improved gripping.

Cooperating glass **80*a* includes recess 82 configured to receive arms 36*a* of clamp 26*a*. The top portion of recess 22 is cut away to form notch 84 so that retainer 10*a*, when positioned in recess 82, will be entirely disposed below the lip of glass 80*a*. In a further variation also illustrated in FIG. 4, outer arm 36*a* includes a nipple extending inwardly at 46 for engagement with detent 88 on surface 86 of recess 82 to firmly engage and anchor ice retainer 10*a* on drinking glass 80*a***.

Figure 6:
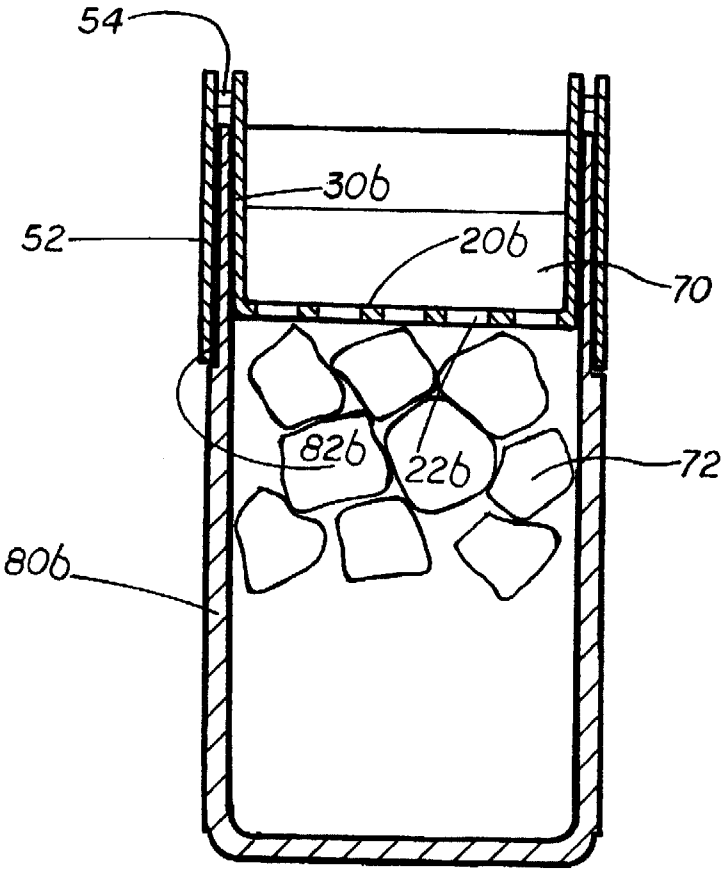
FIG. 6 is a cross-sectional illustration through line 6—6 of FIG. 5 showing the combined ice retainer and drinking vessel engaged for use and containing a beverage and ice.
Figure 5:
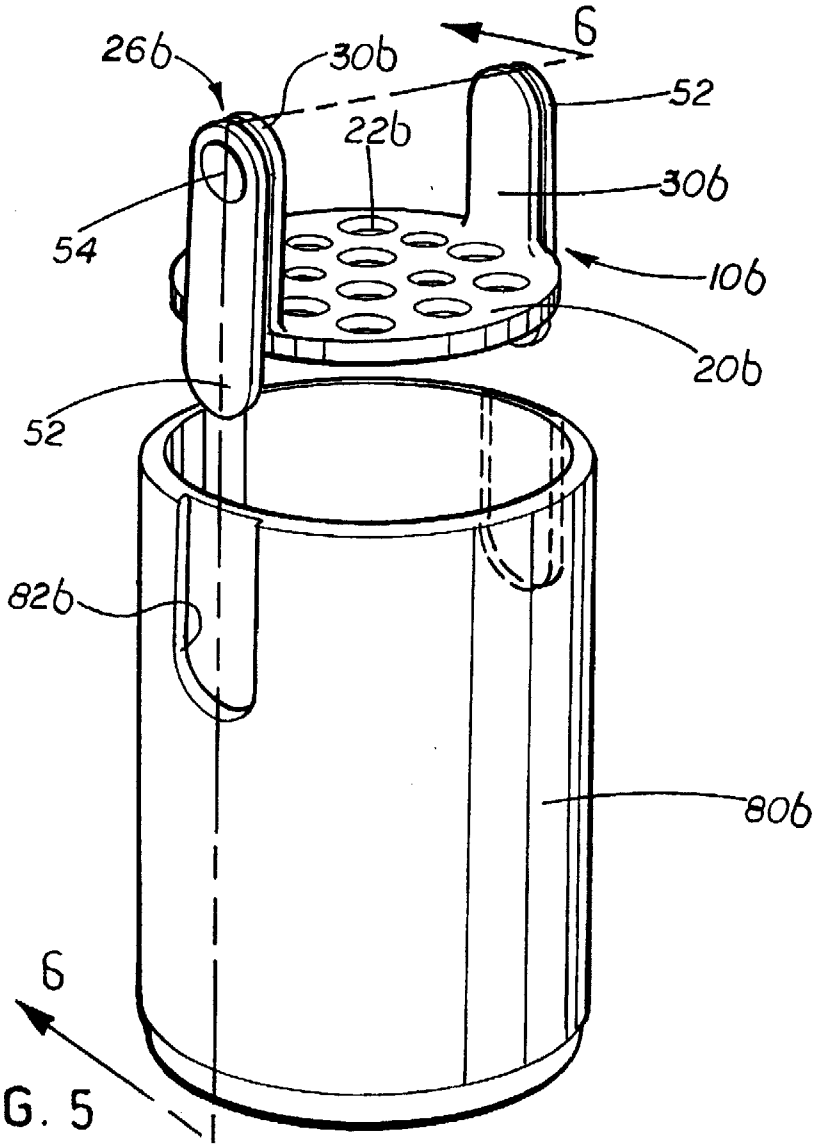
FIG. 5 is a perspective illustration of an alternative ice retainer in accord with the present invention in combination with a drinking glass specifically designed for cooperation therewith.

FIGS. 5 and 6 illustrate another alternative embodiment of the present invention wherein clip **26*b* is frictionally engaged with glass 80*b*. In this embodiment, ice retainer 10*b* includes shield 20*b* having a plurality of holes 22*b* therein. In the illustrated embodiment, ice retainer 10*b* includes a pair of diametrically positioned clips 26*b* disposed at the ends of integrally molded stems 30*b*. Clips 26*b* include outer arms 52 attached to the upper end of stems 30*b* through connectors 54. Glass 80*b* includes a pair of diametrically opposed recesses 82*b* extending downward from the lip for receiving arms 52 therein. Connectors 54 are sized so that stems 30*b* and outer arms 52 are separated by substantially the same distance as the thickness of the wall of glass 80*b* at recess 82*b***.

The cross-sectional illustration of FIG. 6 shows glass **80*b* filled with beverage 70. Also included are ice cubes 72 held below shield 20*b*** to illustrate the benefits of the present invention.

Figure 7:
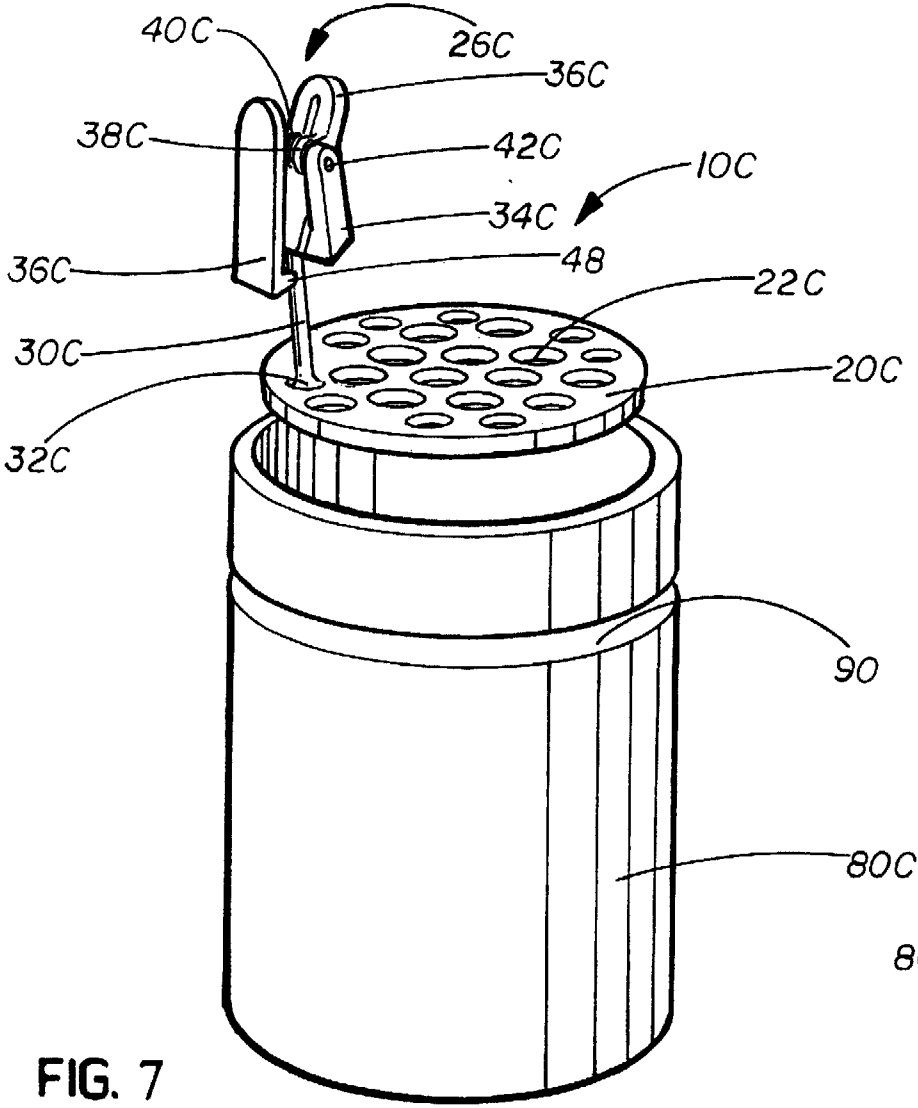
FIG. 7 is a perspective illustration of yet another alternative ice retainer in accord with the present invention in combination with a drinking vessel designed for cooperation therewith.

Still another alternative embodiment of the present invention is illustrated in FIG. 7. Ice retainer **10*c* includes shield 20*c* having therein a plurality of holes 22*c* and disposed on a first end 32*c* of stem 30*c*. Affixed at the opposite end of stem 30*c* is clip 26*c* comprising opposed arms 36*c* carried about pin 42*c* by securing tabs 38*c*. Pin 42*c* is disposed across the open end of yoke 34*c* on the end of stem 30*c*. Opposed arms 36*c* are biassed to the closed position by spring 40*c* also carried on pin 42*c*. Projecting inwardly from the lower end of outer arm 36*c* is ridge 48 designed for cooperation with groove 90 about the outer periphery of glass 80*c***.

Figure 8:
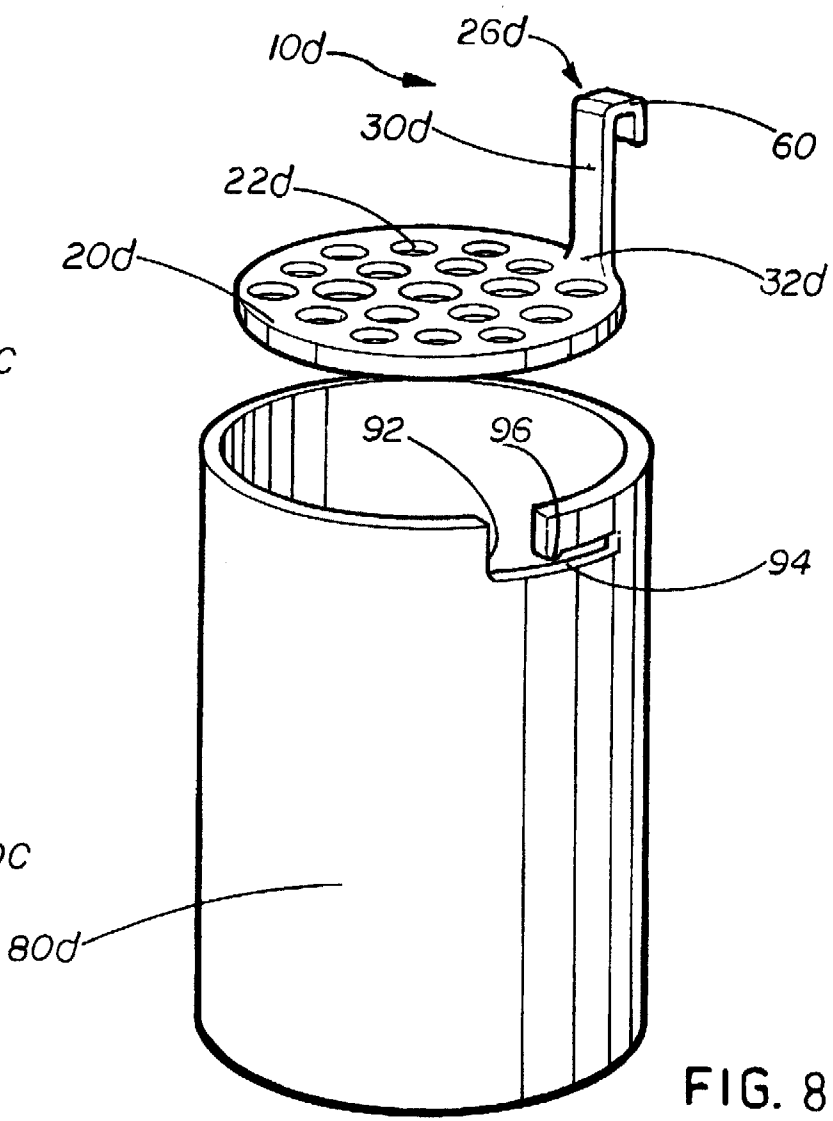
FIG. 8 is a perspective illustration of still another alternative ice retainer in accord with the present invention in combination with a drinking vessel specifically designed for cooperation therewith.

FIG. 8 illustrates yet another embodiment of the ice retainer of the present invention. In this simple, yet elegant embodiment, ice retainer **10*d* is comprised of a single unitary piece of molded plastic having no moving pans. Shield 20*b*, having a plurality of holes 22*d*, is disposed at the lower end 32*d* of stem 30*d*. At the upper end of stem 30*d* is disposed clip 26*d* comprising simple hook 60 for cooperation with notch 92 in the lip of glass 80*d*. Notch 92 terminates at its lower end in horizontal slot 94 having boss 96 adjacent notch 92 to provide a primitive locking mechanism to help maintain retainer 10*a* in place. In use hook 60 of ice retainer 10*d* is placed in notch 92 and pushed beyond boss 96 into slot 94 where it is snugly retained. In this most simple embodiment, the entirety of ice retainer 10*d* is disposed below the lip of glass 80*d***.

The foregoing description of the invention has been directed in primary part to several particularly preferred embodiments in accordance with the requirements of the Patent Statute and for purposes of explanation and illustration. It will be apparent, however, to those skilled in the art that many modifications and changes in the specifically described embodiments may be made without departing from the true scope and spirit of the invention. For example, one or more slots may be substituted for holes 22 in shield 20. In fact, shield 20 may alternatively comprise a solid peripheral ring having a screen disposed across a large central opening. These and other alternatives will be readily apparent to those of skill in the art. Therefore, the invention is not restricted to the preferred embodiments described and illustrated but covers all modifications which may fall within the scope of the following claims.

What is claimed is:

1. A combination beverage container and ice retainer, comprising:

a vessel for holding ice and a beverage;

a shield for retaining ice in said vessel, said shield being circular in shape and substantially the same size as an interior cross section of said vessel at a selected distance below a lip of said vessel;

a clip for engagement with said lip of said vessel; and a stem having a first end affixed to said shield and a second end pivotally engaged through a yoke to said clip, said stem being of a length to position said shield at said selected distance below said lip of said vessel when said clip is engaged with said lip.

2. The combination of claim 1 further comprising a plurality of openings through said shield, said openings sized to retain substantially all of said ice in said vessel while permitting said beverage to pass therethrough.

3. The combination of claim 2 further comprising means for biassing said clip for engagement with said lip.

4. The combination of claim 1 wherein said vessel further comprises a recess in said lip for receiving said clip.

5. The combination of claim 4 wherein said recess includes a slot below said lip so that said shield and stem are disposed below said lip when said clip is engaged within said recess.

6. A device for use with a beverage container containing both ice and a beverage, comprising:

a shield for retaining ice in a beverage container, said shield being circular in shape and substantially the same size as an interior cross section of said container at a chosen distance below a lip of said container;

a plurality of openings through said shield, said openings sized to retain substantially all of said ice in said container while permitting said beverage to pass therethrough;

a clip for engagement with said lip of said container; and a stem having a first end affixed to said shield and a second end pivotally engaged through a yoke to said clip, said stem being of a length to position said shield at said chosen distance below said lip of said container when said clip is engaged with said lip.

7. The device of claim 6 further comprising means for biassing said clip for engagement with said lip.

8. The device of claim 7 wherein said biassing means is a spring.

9. The device of claim 6 wherein said clip frictionally engages said lip of said glass.

10. A device for retaining solids within a vessel containing both a liquid and said solids, comprising:

a shield for holding said solids in said vessel, said shield shaped to conform generally to at least a portion of an interior cross section of said vessel at a chosen distance below a lip of said vessel;

a clip for engagement with said lip of said vessel; and a stem having a first end affixed to said shield and a second end pivotally engaged through a yoke to said clip.

11. The device of claim 10 further comprising a plurality of openings through said shield, said openings sized to retain substantially all of said solids in said vessel while permitting said liquid to pass therethrough.

12. The device of claim 11 wherein said openings comprise a plurality of slots through said shield.

13. The device of claim 10 wherein said shield comprises a screen surrounded by a solid periphery to which said stem is affixed.

14. The device of claim 10 wherein said stem is of a length to position said shield at said chosen distance when said clip is engaged with said lip of said vessel.

15. The device of claim 10 further comprising means for biassing said clip for engagement with said lip.

16. The device of claim 15 wherein said biassing means is a spring.

17. The device of claim 10 wherein said shield is circular in shape and substantially the same size as said interior cross section.

* * * * *